US007673356B1

(12) United States Patent
Conyers

(10) Patent No.: US 7,673,356 B1
(45) Date of Patent: Mar. 9, 2010

(54) HEAD AND NECK SUPPORT APPARATUS

(76) Inventor: Christie C. Conyers, 1953 Kingston Ln., Hinesville, GA (US) 31313

( * ) Notice: Subject to any disclaimer, the term of this patent is extended or adjusted under 35 U.S.C. 154(b) by 0 days.

(21) Appl. No.: 12/116,293

(22) Filed: May 7, 2008

Related U.S. Application Data

(60) Provisional application No. 60/939,682, filed on May 23, 2007.

(51) Int. Cl.
*A47C 20/00* (2006.01)
*A45D 19/04* (2006.01)
*A47K 3/024* (2006.01)

(52) U.S. Cl. ..... 5/643; 5/636; 5/655; 4/572.1; 4/573.1

(58) Field of Classification Search ..... 5/636, 5/643, 655, 504.1–506.1, 662; 4/572.1, 573.1; 297/452.13, 440.11
See application file for complete search history.

(56) References Cited

U.S. PATENT DOCUMENTS 2,229,411 A * 1/1941 Hughes ..... 297/487
2,460,308 A * 2/1949 Pribil ..... 4/572.1
2,581,802 A * 1/1952 Lyons ..... 5/643
2,695,415 A * 11/1954 Holton ..... 5/655
2,722,693 A * 11/1955 Wolf ..... 5/426
3,474,473 A * 10/1969 Hannaberg ..... 5/426
D251,521 S * 4/1979 Gibson ..... D6/382
4,570,275 A * 2/1986 Merriman ..... 5/505.1
4,802,252 A * 2/1989 Marmor ..... 5/505.1
5,337,429 A * 8/1994 Tucker ..... 5/643
5,360,258 A * 11/1994 Alivizatos ..... 297/440.11
5,471,689 A * 12/1995 Shaw et al. ..... 5/662
6,581,226 B1 * 6/2003 Brustein ..... 5/643

* cited by examiner

*Primary Examiner*—Robert G Santos
(74) *Attorney, Agent, or Firm*—Jonathan Rigdon Smith, PC; Jonathan R. Smith

(57) ABSTRACT

A flexible tubular frame, comprising an upper section and a lower section, supports a person's neck and head for hygienic, therapeutic, or cosmetic purposes. The upper section has a depressed portion shaped for supporting a person's neck when the person lies within the open ends of the base frame and the upper frame.

5 Claims, 6 Drawing Sheets

HEAD AND NECK SUPPORT APPARATUS

PRIORITY

Priority of this nonprovisional application for patent is claimed on U.S. provisional application Ser. No. 60/939,682 filed May 23, 2007.

FIELD OF INVENTION

This invention is in the field of support structures, more particularly of structures intended for supporting parts of the human body. It is also in the fields of human hygiene devices and accessories for hairdressing and cosmetology.

BACKGROUND OF INVENTION

Hairdressers have long used specially-shaped sinks to help support a customer's head and neck as her hair is treated or washed. This typically takes a form similar to the sink depicted in FIG. 1. The key feature of such a sink is depressed rim 1. The depressed rim 1 supports a person's neck and head from below, while the elevated portion 2 of the rim, in combination with the presence of a person's head, maintains an overall wall height sufficient to keep splashing of liquid out of the sink to a minimum. The depressed rim 1 itself, because it is firmly seated underneath a person's neck, also serves to prevent liquid from running down the neck away from the sink and into the person's clothing. Customers using such a sink often find, as a side benefit, that support under the neck is much more comfortable than their having to support their head and neck horizontally from the back of a chair.

BRIEF DESCRIPTION OF INVENTION

A need has long existed for a more comfortable support for a person's, especially a child's, neck and head during hair washing. This invention is such an apparatus. It consists of an essentially open rectangular base section, supporting at its open end another essentially open rectangular upper section. The upper section has a depressed portion shaped for supporting a person's neck when the person lies within the open ends of the base section and the upper section. While the initial prototype was built for washing a child's hair on a counter top, it can be used in a large sink or bathtub. A larger and more rigid version could be utilized on adults, and with appropriate means to control moisture, it could be used in a crib or bed. As dimensioned in the drawings, it is intended for use on either infants or children up to the age of about four years.

OBJECTS OF INVENTION

The principal object of the invention is to provide support for a person's head and neck while he or she lies on a counter top or in a bathtub, so that their hair can be treated or washed by another in comfort for both the person being bathed and the person performing the activity. Another object of the invention is to provide a support apparatus that aids a person bathing another person in controlling the movements of the person being bathed. A third object of the invention is potentially to limit wetting of surfaces below the neck of the person being bathed on a horizontal surface by creating a barrier under their neck.

DETAILED DESCRIPTION OF INVENTION

Figure 1:
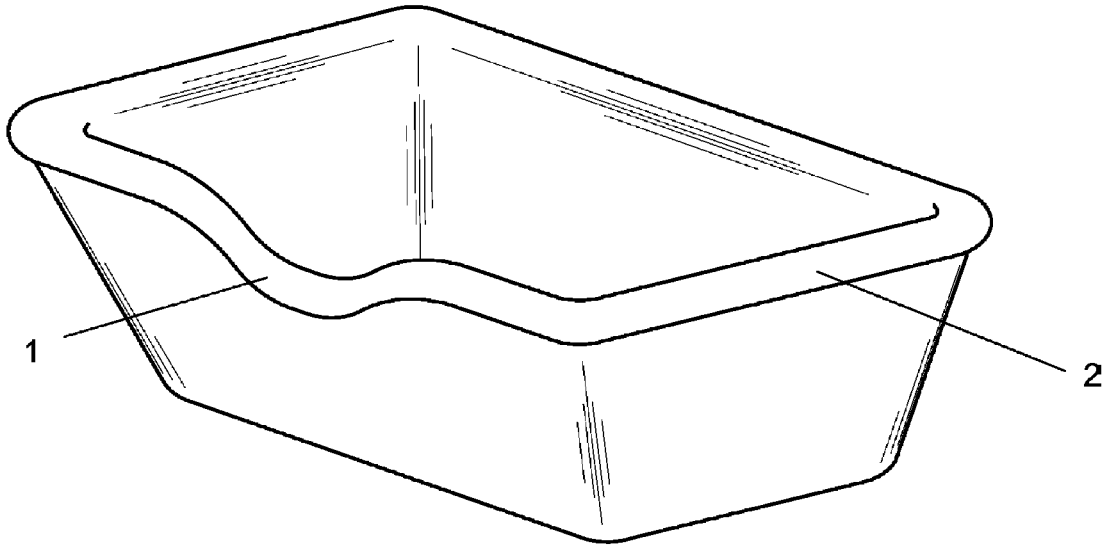
FIG. 1 PRIOR ART
FIG. 1 is a perspective view of the prior art sink.

Referring now to the drawings, in which like elements in each drawing are represented by like reference numerals, FIG. 1 is a perspective view of the prior art sink. Its key feature is depressed rim 1. The depressed rim 1 supports a person's neck and head from below, while the elevated portion 2 of the rim, in combination with the presence of a person's head, maintains an overall wall height sufficient to keep splashing of liquid out of the sink to a minimum. The depressed rim 1 itself, because it is firmly seated underneath a person's neck, also serves to prevent liquid from running down the neck away from the sink and into the person's clothing.

Figure 2:
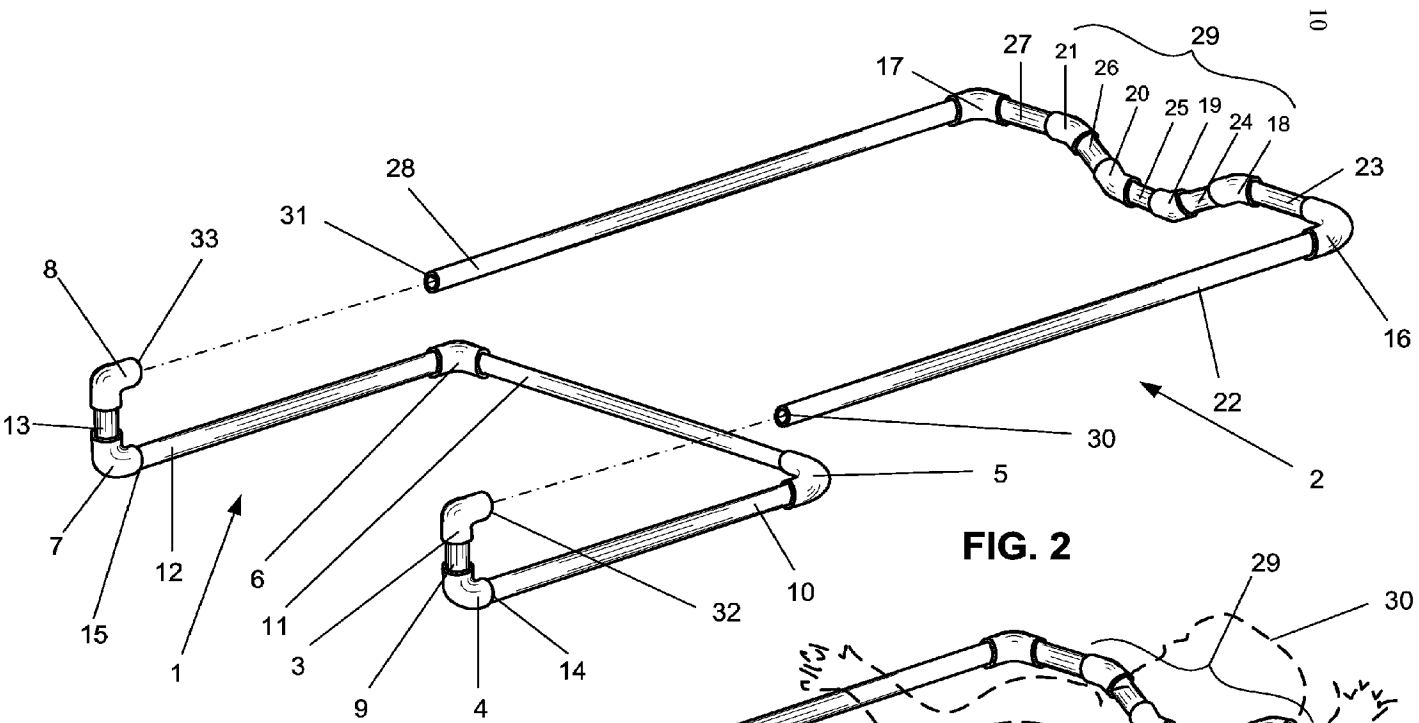
FIG. 2 is a perspective view of a first embodiment of the invention shown in two sections.

FIG. 2 is a perspective view of a first embodiment of the invention, designed and built for use on infants and children up to the age of about four. The limit on the size or age of the child is determined by the thickness and rigidity of the parts, which for the range in age up to about four are nominal half-inch PVC schedule 40 pipe. The first embodiment is constructed of these parts by application of cement to the joints. Thus, the dimensions given in this description for the cut pieces of pipe are shorter by approximately ¾" at each end when put together than the final apparatus.

The first embodiment is comprised of two main parts as shown in FIG. 2, base section 1 and top section 2. Base section 1 is constructed of 90-degree elbows 3, 4, 5, 6, 7 and 8, and straight pipe sections 9, 10, 11, 12, and 13, forming an open rectangle comprising straight pipe sections 10, 11, and 12, and uprights comprised of short pipe sections 9 and 13. Base section 1 can be folded flat if joints 14 and 15 are not cemented, allowing elbows 4 and 7 to be rotated 90 degrees about straight sections 10 and 12. Top section 2 is constructed of 90-degree elbows 16 and 17, 45-degree elbows 18, 19, 20 and 21, and straight pipe sections 22, 23, 24, 25, 26, 27 and 28. The 45-degree elbows 18-21 and the straight pipe sections 24-26 make up a head rest 29. The entirety of the first embodiment is formed by inserting straight pipe ends 30 and 31 of top section 2 into the horizontal openings 32 and 33 in elbows 3 and 8, respectively, of base section 1. The entire first embodiment consisting of both the base section 1 and the top section 2 joined at elbows 3 and 8 may be folded flat if all four elbows 3, 4, 7, and 8 are not cemented but allowed to rotate 90 degrees. This and all of the subsequently-described embodiments, after assembly, comprise a horizontal elongate head and neck support member represented in this first embodiment by straight pipe sections 23 through 27 connected by 45-degree elbows, left and right resilient suspension members represented by straight pipe sections 22 and 28 connected to the support member by 90-degree elbows, left and right upright members represented by short pipe sections 9 and 13 connected to the suspension members by 90-degree elbows, and three foot members represented by straight pipe sections 10 through 12 arranged in an open-ended rectangle connected to each other and to the uprights by 90-degree elbows.

It has been found by experimentation on children up to the age of about four that the preferred set of dimensions for straight pipe sections 9-13 and 22-28 should (before insertion into their receiving elbows) be 4, 12, 14, 12, 4, 18, 2, 2.5, 2.5, 2.5, 2, and 18 inches, respectively.

Figure 3:
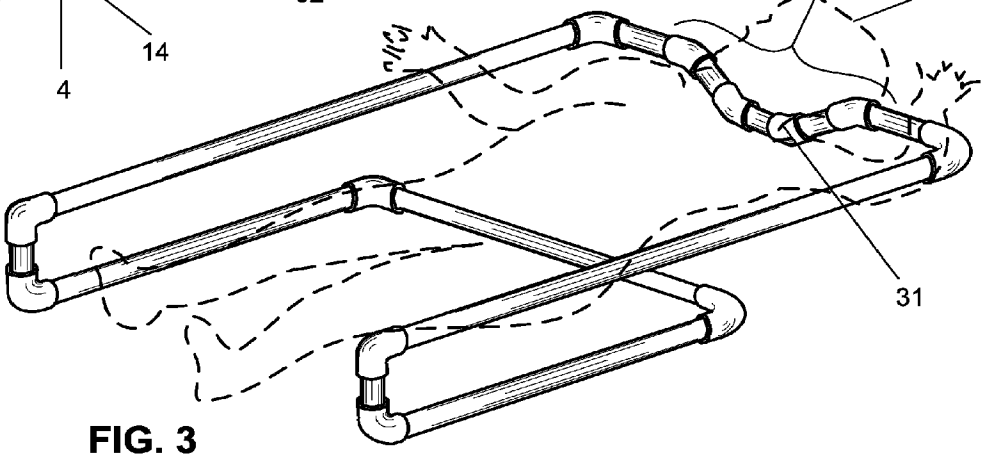
FIG. 3 is a perspective view of the preferred embodiment fully assembled.

FIG. 3 is a perspective view of the first embodiment fully assembled, showing as environmental structure (dashed lines) an infant 30 in a recumbent position. The child's neck 31 is supported by head rest 29. It has been found by experimentation that straight pipe sections 22 and 28, if made of schedule 40 PVC pipe 18 inches long, provide comfortable resilient suspension of the neck, back and head of children up to the age of approximately four years. Persons of other ages, sizes, and weights may be comfortably supported by other combinations of pipe or tubing thickness, length and material, and such alternative combinations are included in the scope of this invention without limitation.

Figure 4:
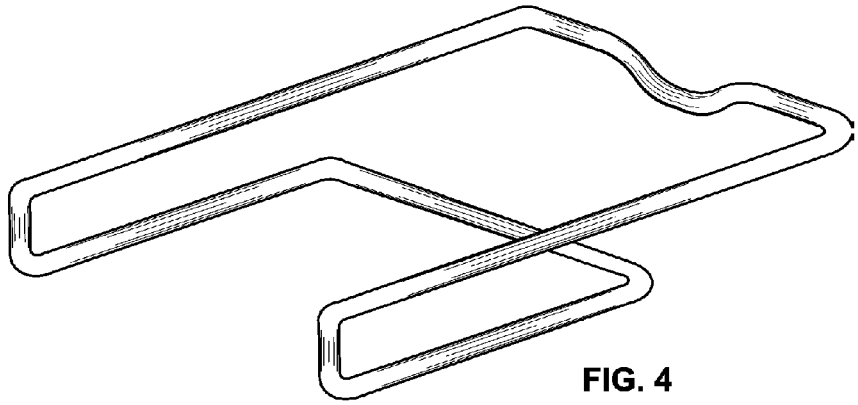
FIG. 4 is a perspective view of a second embodiment of the invention.

FIG. 4 is a perspective view of a second embodiment of the invention. It has the same basic shape as the first embodiment but is either molded in a unitary fashion or crafted from parts that fit together seamlessly.

Figure 5:
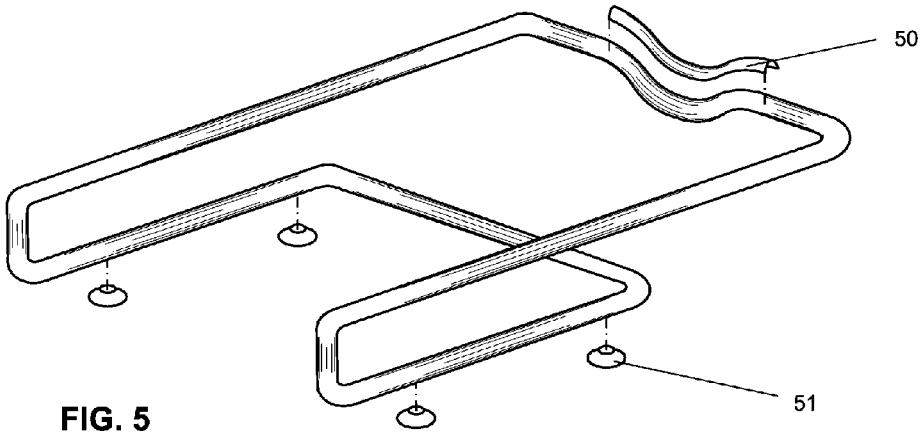
FIG. 5 is a perspective view of a third embodiment of the invention.

FIG. 5 is a perspective view of a third embodiment of the invention. This embodiment features the amenities of a smooth neck rest 50 on top section 2 and/or suction cups 51 on base section 1. The suction cups help secure the invention on a smooth nonporous surface such as a counter top or the bottom of a bathtub while also protecting the supporting surface from scratching.

Figure 6:
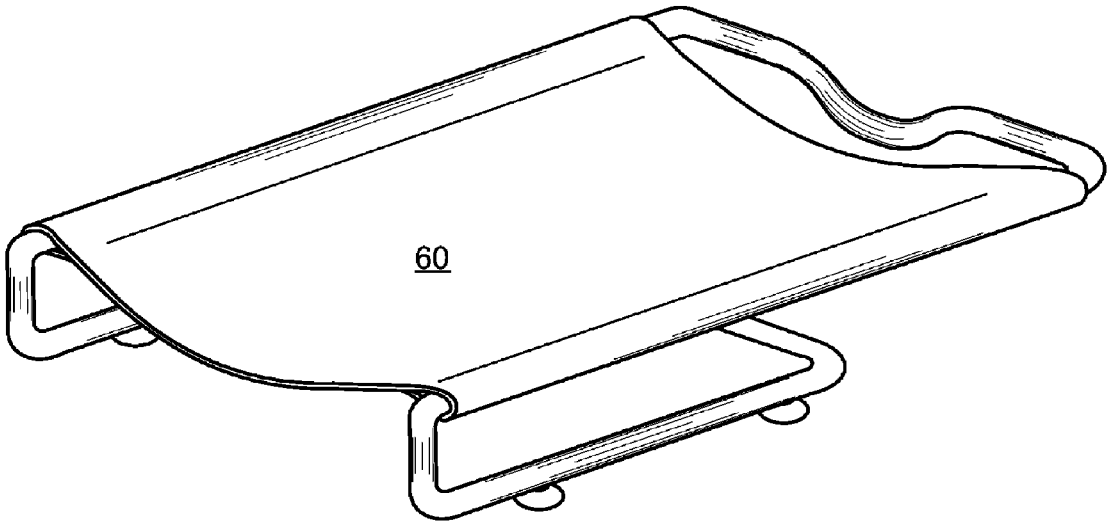
FIG. 6 is a perspective view of a fourth embodiment of the invention.

FIG. 6 is a perspective view of a fourth embodiment of the invention. It is the same as the third embodiment of the invention with the addition of a flexible sheet 60. The sheet 60 serves to provide a smooth, comfortable surface against a user's skin. If it is composed of water repellent material, it also may serve to reduce the wetting of surfaces under the apparatus. Sheet 60 may also be decorative in nature.

Figure 7:
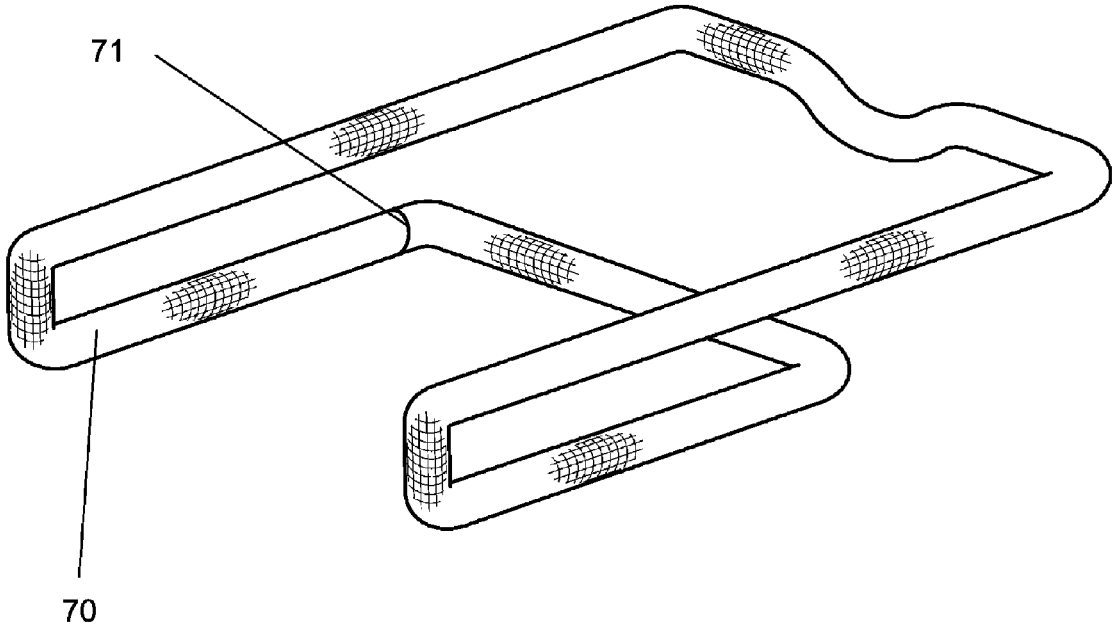
FIG. 7 is a perspective view of the preferred embodiment of the invention.

FIG. 7 is a perspective view of a fifth, preferred, embodiment of the invention. It is the same as the first or second embodiments of the invention with the added feature of all the parts being wrapped in resilient material, thereby providing comfortable softness under the head and neck of a user while also reducing the potential for slippage on, and damage to, the supporting surface. The resilient material may comprise a tube 70 of the material that is slipped over all the parts of the first embodiment as they are assembled, finally meeting itself at joint 71. The tube 70 may be water repellent for ease of cleaning and may also be decorative in nature.

Figure 8:
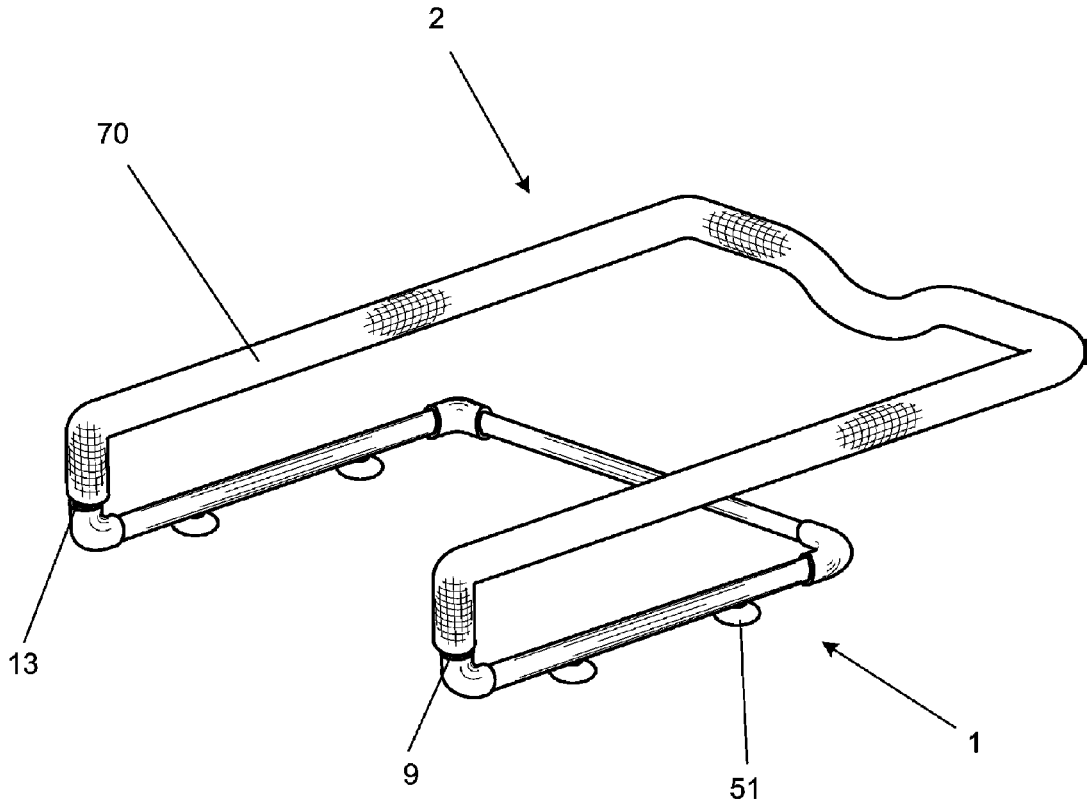
FIG. 8 is a perspective view of a sixth embodiment of the invention.

FIG. 8 is a perspective view of a sixth embodiment of the invention, similar to the preferred embodiment, in which tube 70 is shorter and covers less than the entire structure. In this figure, the example is provided where the tube 70 is only long enough to cover the top section 2 and upright pipe sections 9 and 13. Suction cups 51 have been added to base section 1 as well.

I claim:

1. A head and neck support apparatus, comprising:

the following parts, sized to fit each other and fitted together in concatenated order, to hold the back of a person's head and neck above a surface:

a first pipe placed horizontally;

a first ninety-degree pipe elbow turning right;

a second pipe;

a second ninety-degree pipe elbow turning right;

a third pipe;

a third ninety-degree pipe elbow turning vertically upward;

a fourth pipe;

a fourth ninety-degree pipe elbow turning horizontal;

a fifth pipe;

a fifth ninety-degree pipe elbow turning left;

a sixth pipe;

a first forty-five-degree pipe elbow turning diagonally down;

a seventh pipe;

a second forty-five-degree pipe elbow turning diagonally up to horizontal;

an eighth pipe;

a third forty-five-degree pipe elbow turning diagonally up;

a ninth pipe;

a fourth forty-five-degree pipe elbow turning down to horizontal;

a tenth pipe;

a sixth ninety-degree pipe elbow turning left;

an eleventh pipe;

a seventh ninety-degree pipe elbow turning vertically down;

a twelfth pipe; and an eighth ninety-degree pipe elbow turning horizontal and joining the first pipe.

2. The apparatus of claim 1, in which:

said pipes and elbows are ½-inch schedule 40 pipe, and the lengths of said first through twelfth pipes are approximately 12, 14, 12, 4, 18, 2, 2.5, 2.5, 2.5, 2, 18, and 4 inches, respectively.

3. The apparatus of claim 2, in which:

a resilient covering is wrapped around at least said fourth through said twelfth pipes and said fourth through said seventh elbows.

4. The apparatus of claim 3, in which:

a plurality of cushion pads are affixed to the underside of said first and third pipes to protect surfaces underneath the apparatus.

5. The apparatus of claim 4, in which:

said cushion pads are suction cups.

* * * * *